US009508324B2

(12) United States Patent
Ohnishi et al.

(10) Patent No.: US 9,508,324 B2
(45) Date of Patent: Nov. 29, 2016

(54) SOUNDBOARD ACOUSTIC TRANSDUCER

(71) Applicant: Yamaha Corporation, Hamamatsu-Shi, Shizuoka-Ken (JP)

(72) Inventors: Kenta Ohnishi, Hamamatsu (JP); Yuji Takahashi, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/161,379

(22) Filed: Jan. 22, 2014

(65) Prior Publication Data

US 2014/0202318 A1 Jul. 24, 2014

(30) Foreign Application Priority Data

Jan. 22, 2013 (JP) ..... 2013-008906

(51) Int. Cl.
*G10H 1/32* (2006.01)
*G10C 3/06* (2006.01)
*G10H 3/22* (2006.01)

(52) U.S. Cl.
CPC *G10C 3/06* (2013.01); *G10H 1/32* (2013.01); *G10H 3/22* (2013.01); *G10H 2210/271* (2013.01); *G10H 2220/461* (2013.01); *G10H 2230/011* (2013.01)

(58) Field of Classification Search
USPC ..... 84/723
See application file for complete search history.

(56) References Cited

U.S. PATENT DOCUMENTS 5,755,416 A * 5/1998 Leek ..... 248/247
5,981,861 A 11/1999 Van Delinder et al.
6,965,679 B1 11/2005 Lopez Bosio et al.
7,085,391 B1 8/2006 Yamaya
2006/0115107 A1 6/2006 Vincent et al.
2010/0147132 A1 6/2010 Shinjo et al.
2013/0061733 A1* 3/2013 Ohnishi et al. ..... 84/174
2015/0128790 A1 5/2015 Ohnishi et al.
2015/0356961 A1 12/2015 Takahashi et al.

FOREIGN PATENT DOCUMENTS

CN 1195454 A 10/1998
CN 101763849 A 6/2010
DE 3831187 A1 3/1990
EP 1 227 700 A1 7/2002
EP 2 571 016 A2 3/2013
EP 2 793 221 A1 10/2014
JP 59-500531 A 3/1984
JP 4500735 A 2/1992
JP H05-158467 A 6/1993
JP H05-204376 A 8/1993
JP 2000-315088 A 11/2000

(Continued)

OTHER PUBLICATIONS

European Search Report dated May 9, 2014, for EP Application No. 14151563.5, five pages.

(Continued)

*Primary Examiner* — Christopher Uhlir

(74) *Attorney, Agent, or Firm* — Morrison & Foerster LLP

(57) ABSTRACT

A soundboard acoustic transducer, including: a main body; and a vibrator configured to vibrate a soundboard in response to a sound signal input thereto, wherein the main body is supported by a member different from the soundboard, via a fixture formed by a metal plate.

7 Claims, 15 Drawing Sheets

(56) References Cited

FOREIGN PATENT DOCUMENTS

| | | | |
|---|---|---|---|
| JP | 2007-328186 | A | 12/2007 |
| JP | 2008-225498 | A | 9/2008 |
| JP | 2008-268777 | A | 11/2008 |
| JP | 2008-292739 | A | 12/2008 |
| JP | 2008-298991 | A | 12/2008 |
| JP | 2008-298992 | A | 12/2008 |
| JP | 2009-015019 | A | 1/2009 |
| JP | 2009-135956 | A | 6/2009 |
| JP | 2010-007835 | A | 1/2010 |
| JP | 4735662 | B2 | 7/2011 |
| JP | 2012-230406 | A | 11/2012 |
| TW | 466468 | B | 12/2001 |
| WO | WO-83/03022 | A1 | 9/1983 |
| WO | WO-9003025 | A1 | 3/1990 |
| WO | WO-97/09842 | A2 | 3/1997 |
| WO | WO-2014/115482 | A1 | 7/2014 |

OTHER PUBLICATIONS

International Search Report mailed Mar. 4, 2014, for PCT Application No. PCT/JP2013/085055, with English translation, five pages.

Notification of Reason for Refusal dated Jan. 29, 2015, for JP Patent Application No. 2013-008906, with English translation, seven pages.

Chinese Office Action dated May 5, 2016, for CN Application No. 201410030984.8, with English translation, eleven pages.

Chinese Search Report dated May 5, 2016, for CN Application No. 201410030984.8, with English translation, four pages.

Non-Final Office Action mailed Nov. 10, 2015, for U.S. Appl. No. 14/762,611, filed Jul. 22, 2015, eleven pages.

Notification of first Office Action dated Mar. 24, 2015, for TW Patent Application No. 102147003, with English translation, six pages.

Extended European Search Report dated Sep. 28, 2016, for EP Application No. 13872580.9, nine pages.

* cited by examiner

SOUNDBOARD ACOUSTIC TRANSDUCER

CROSS REFERENCE TO RELATED APPLICATION

The present application claims priority from Japanese Patent Application. No. 2013-008906, which was filed on Jan. 22, 2013, the disclosure of which is herein incorporated by reference in its entirety.

BACKGROUND OF THE INVENTION

Field of the Invention

The present invention relates to a soundboard acoustic transducer used in pianos, electronic musical instruments, and other acoustic signal generating devices and configured to generate musical instrument sounds by causing a soundboard to be vibrated by means of a vibrator.

Description of Related Art

As described in the following Patent Literatures 1 and 2, soundboard acoustic transducers are known. In the disclosed soundboard acoustic transducers, an acoustic transducer is installed on a soundboard of pianos, electronic musical instruments, and so on, and the acoustic transducer is driven by a musical instrument sound signal, whereby musical instrument sounds by vibration of the soundboard can be heard. In the soundboard acoustic transducer described in the Patent Literature 2, speakers are additionally provided, and musical instrument sounds are generated from the speakers in addition to those generated by the vibration of the soundboard.

Patent Literature 1: JP-A-04-500735

Patent Literature 2: Japanese Patent No. 4735662

SUMMARY OF THE INVENTION

In the soundboard acoustic transducers disclosed in the above Patent Literatures 1 and 2, the acoustic transducer is installed on the soundboard only, and the musical instrument sounds by the vibration of the soundboard are generated toward the exterior. Accordingly, the musical instrument sounds generated toward the exterior are determined by vibration characteristics of the soundboard. However, the soundboard has vibration characteristics that the soundboard is less likely to vibrate in response to high-frequency signals. Therefore, the conventional soundboard acoustic transducers described above suffer from a problem that a high-frequency component is insufficient in musical instrument sounds generated by the vibration of the soundboard and musical instrument sounds that sufficiently include the high-frequency component cannot be effectively generated. In the above Patent Literature 2, musical instrument sounds are generated from speakers in addition to the vibration of the soundboard. In this instance, however, the speakers are additionally required for generating musical instrument sounds that sufficiently include the high-frequency component.

The present invention has been developed to deal with the problems described above. It is therefore an object of the invention to provide a soundboard acoustic transducer capable of generating musical instrument sounds that sufficiently include the high-frequency component in a simple structure. In the following description of constituent elements of the invention; reference numerals of corresponding portions in the embodiment and modifications are provided together with brackets for easier understanding of the invention. It is to be understood that the constituent elements of the invention should not be construed limitedly to configurations of the corresponding portions indicated by the reference numerals in the embodiment and modifications.

The above-indicated object of the invention may be attained according to a principle to the invention, which provides a soundboard acoustic transducer, comprising: a main body (31, 32, 33, 34); and a vibrator (35, 36, 37) configured to vibrate a soundboard (7, 7B) in response to a sound signal input thereto, wherein the main body is supported by a member (9, 9B, 90B) different from the soundboard, via a fixture (40, 40B) formed by a metal plate.

According to the soundboard acoustic transducer constructed as described above, when the vibrator is vibrated by a sound signal input thereto, the soundboard is vibrated in response to the sound signal and the fixture vibrates as well in response to the sound signal. Because the fixture is formed by a metal plate, the fixture is readily to vibrate in response to a high-frequency component of the sound signal and sounds by the vibration of the fixture sufficiently include the high-frequency component of sounds to be generated. Accordingly, even if sounds by the vibration of the soundboard are insufficient in the high-frequency component, the vibration of the fixture complements the high-frequency component, so that sounds that sufficiently include the high-frequency component are generated. Therefore, a performer of a musical instrument equipped with the soundboard acoustic transducer and people who are present near the performer, for instance, can hear good musical instrument sounds.

FORMS OF THE INVENTION

There will be described various forms of the invention.

A soundboard acoustic transducer, comprising: a main body (31, 32, 33, 34); and a vibrator (35, 36, 37) configured to vibrate a soundboard (7, 7B) in response to a sound signal input thereto, wherein the main body is supported by a member (9, 9B, 90B) different from the soundboard, via a fixture (40, 40B) formed by a metal plate.

In the soundboard acoustic transducer constructed as described above, the fixture (40, 40B) may be configured to vibrate in a perpendicular direction with respect to a plate surface thereof in a frequency range at least from 4 kHz to 15 kHz.

In the soundboard acoustic transducer constructed as described above, the fixture (40, 40B) may be constructed to have an L-shaped cross-sectional shape such that the fixture has a first flat plate portion (41, 41B) and a second flat plate portion (42, 42B), the first flat plate portion being fixed to the main body (31, 32, 33, 34) while the second flat plate portion is fixed to the member (9, 9B). In this instance, the main body may be fixed to a lower surface or an upper surface of the first flat plate portion or may be fixed to the first flat plate portion via a support member (54).

In the soundboard acoustic transducer constructed as described above, the fixture (40) may have at least one extending portion (41*b*, 41*c*) that extends integrally from the first flat plate portion (41). According to the soundboard acoustic transducer, when the first flat plate portion vibrates, the extending portion vibrates in a direction different from a direction in which the first flat plate portion 41 vibrates. Accordingly, sounds that consist of the high-frequency component of the sound signal by the vibration of the first flat plate portion and the vibration of the extending portion propagate in various directions, so that the acoustic characteristics of the sounds become much better.

In the soundboard acoustic transducer constructed as described above, the fixture (40, 40B) may have a first flat plate portion (41, 41B) fixed to the main body (31, 32, 33, 34) and a second flat plate portion (42, 42B, 43B) fixed to the member (9, 9B, 90B).

In the soundboard acoustic transducer constructed as described above, the first flat plate portion (41) may have at least one extending portion (41*b*, 41*c*) that is supported by the first flat plate portion and that extends in a substantially perpendicular direction with respect to the first flat plate portion.

In the soundboard acoustic transducer constructed as described above, each of the at least one extending portion (41*b*, 41*c*) may be provided so as to be spaced apart from the second flat plate portion (42).

In the soundboard acoustic transducer constructed as described above, a protrusion (41*d*) having one of a circular cross-sectional shape and an oval cross-sectional shape may be provided on the first flat plate portion (41). According to the soundboard acoustic transducer, the protrusion permits sounds that consist of the high-frequency component of the sound signal to propagate in various directions, so that the acoustic characteristics of the sounds become much better.

In the soundboard acoustic transducer constructed as described above, the main body portion (31, 32, 33, 34) may have a yoke (32, 34) and a magnet (31, 33), and the vibration portion (35, 36, 37) may have a bobbin (35) around which a coil (36) is wound. In this instance, the soundboard may be directly vibrated by the bobbin in response to the sound signal by supplying the sound signal to the coil. Alternatively, there may be provided a drive rod (37,37B) extending from the bobbin and configured to drive the soundboard, and the soundboard may be vibrated in response to the sound signal via the drive rod.

BRIEF DESCRIPTION OF DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Embodiment

<Overall Structure>

Figure 1:
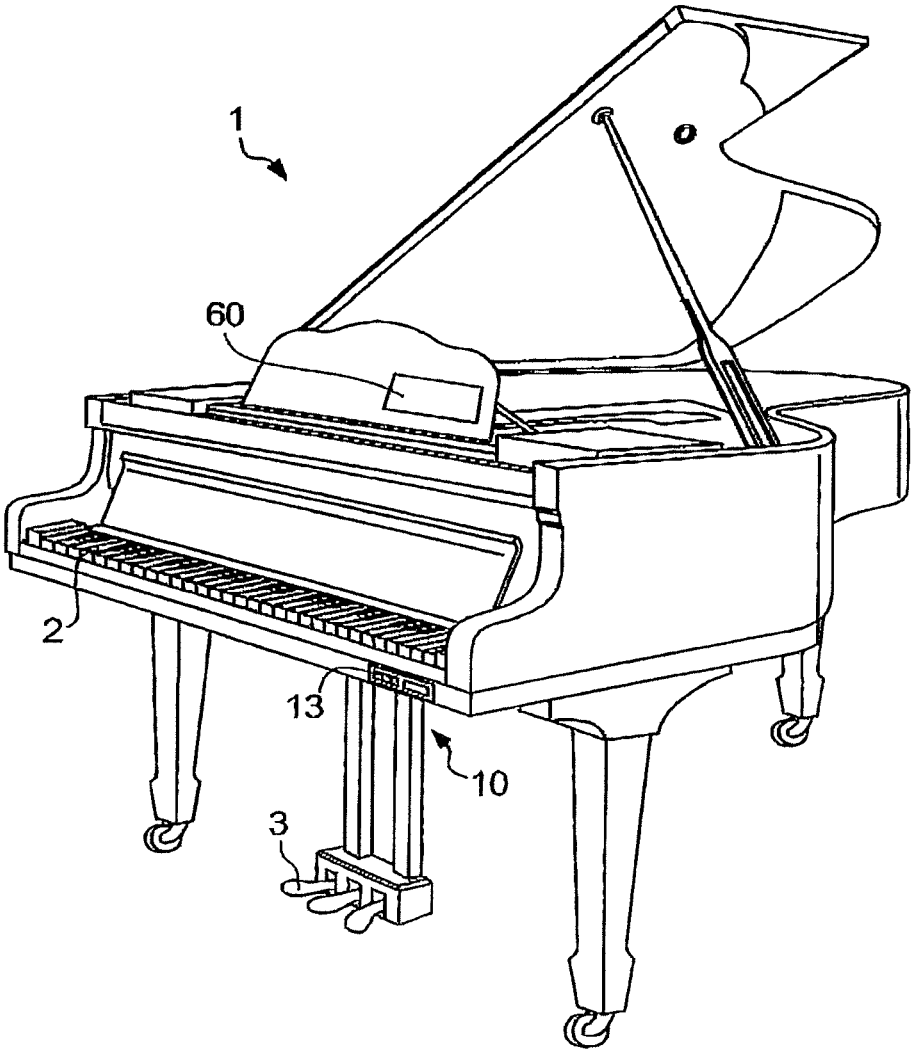
FIG. 1 is a perspective view showing an external appearance of a grand piano according to one embodiment of the present invention.

FIG. 1 is a perspective view showing an external appearance of a grand piano according to one embodiment of the present invention. The grand piano indicated at 1 in FIG. 1 is a keyboard musical instrument that has, on its front side, a keyboard in which are arranged a plurality of keys 2 to be operated for performance by a performer (user) and pedals 3. The grand piano 1 further has a controller 10 having an operation panel 13 on its front surface portion and a touch panel 60 provided at a portion of a music stand. User's instructions can be input to the controller 10 by a user's operation on the operation panel 13 and the touch panel 60.

The grand piano 1 is configured to generate sounds in one of a plurality of sound generation modes that is selected in accordance with a user's instruction. The sound generation modes include a normal sound generation mode, a weak sound mode, and a strong sound mode. In the normal sound generation mode that is intermediate between the weak sound mode and the strong sound mode, sounds are generated only by striking a string by a hammer as in ordinary grand pianos. In the weak sound mode, the string striking by the hammer is prevented, and a soundboard is vibrated by an acoustic transducer using a signal from a sound source such as an electronic sound source (a signal of a piano tone color or a tone color other than the piano tone color), so that sounds are generated from the soundboard with a natural timbre in a volume smaller than usual (or alternatively in a volume larger than usual). In the strong sound mode, sounds are generated by the string striking as in the normal sound generation mode, and further, sounds are generated in a larger volume than that when generated by the string striking by the hammer (the normal sound generation mode), by vibrating the soundboard by means of the acoustic transducer using a signal of the piano tone color. In the strong sound mode, not only a sound volume is increased, but also a tone color layer effect is obtained by simultaneously executing the sound generation by the string striking by the hammer and the sound generation by vibrating the soundboard by means of the acoustic transducer using a signal of a tone color other than the piano tone color (including a tone color that resembles the piano tone color). The sound generation mode may include other sound generation modes such as a sound silencing mode. In the sound silencing mode, the signal from the sound source is not used for excitation of the soundboard, but is supplied to a headphone terminal, in the arrangement of the weak sound mode, thereby preventing sounds to be emitted toward the exterior.

Further, the grand piano 1 is configured to be operated in one of a plurality of performance modes that is selected in accordance with a user's instruction. The performance modes include a normal performance mode in which sounds are generated by a user's performance operation of the grand piano 1 and an automatic performance mode in which the keys 2 are automatically driven based on automatic performance data to generate sounds. It is noted that the grand piano 1 may be configured not to have any one of the two performance modes.

<Structure of Grand Piano 1>

Figure 2:
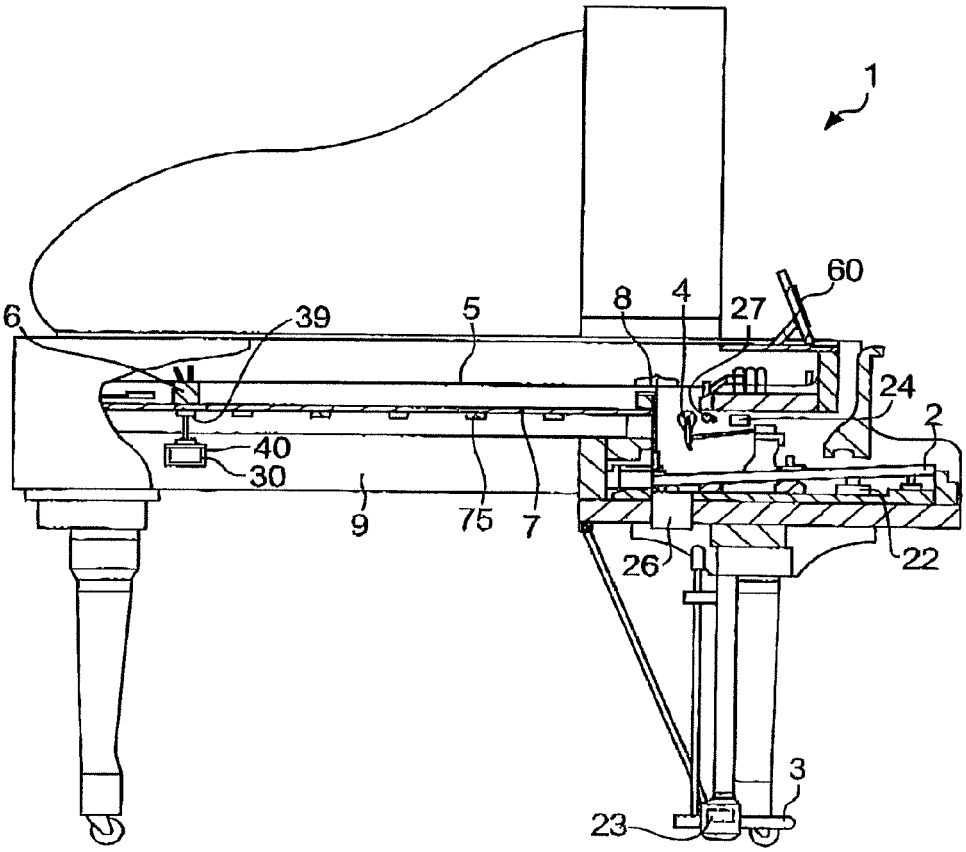
FIG. 2 is a view for explaining an internal structure of the grand piano according to the embodiment of the invention.

FIG. 2 is a view for explaining an internal structure of the grand piano 1. In FIG. 2, structures provided for each of the keys 2 are illustrated focusing on one key 2, and illustration of the structures for other keys 2 is omitted. It is noted that the following explanation will, be made focusing on one key 2 where appropriate for the sake of brevity.

A key drive unit 26 is provided below a rear end portion of each key 2 (i.e., on a rear side of each key 2 as viewed from the user who plays the grand piano 1 on the front side of the grand piano 1). The key drive unit 26 is configured to drive the corresponding key 2 using a solenoid in a case where the automatic performance mode is selected as the performance mode. The key drive unit 26 drives the solenoid in accordance with a control signal sent from the controller 10. That is, the key drive unit 26 drives the solenoid such that a plunger moves upward to reproduce a state similar to that when the user has depressed the key and such that the plunger moves downward to reproduce a state similar to that when the user has released the key. Thus, the normal performance mode and the automatic performance mode differ from each other in that whether the subject that drives the key 2 is the user who plays the grand piano 1 or the key drive unit 26.

Hammers 4 are provided so as to correspond to the respective keys 2. The hammer 4 is configured to move by a force transmitted thereto via an action mechanism (not shown) when the corresponding key 2 is depressed, so that the hammer 4 strikes a corresponding string 5 or strings 5 provided for the key 2. A damper 8 is placed in a non-contact state in which the damper 8 is not in contact with the string(s) 5 or in a contact state in which the damper 8 is in contact with the string(s) 5, in accordance with a depression amount of the key 2 and a step-on amount of a damper pedal among the pedals 3. (In the following description, the "pedal 3" will refer to the damper pedal unless otherwise specified, and the string or strings corresponding to one key is collectively referred to as "string".) When the damper 8 is in contact with the string 5, vibration of the string 5 is suppressed.

A stopper 27 is for preventing the hammer 4 from striking the string 5 when the weak sound mode is set. That is, when the weak sound mode is set as the sound generation mode, a hammer shank hits on the stopper 27 so as to prevent the hammer 4 from striking the string 5. On the other hand, when the normal sound generation mode or the strong sound mode is set as the sound generation mode, the stopper 27 moves to a position at which the hammer shank does not hit on the stopper 27.

Key sensors 22 are provided so as to correspond to the respective keys 2. Each key sensor 22 is disposed below the corresponding key 2 to output, to the controller 10, a detection signal in accordance with a behavior of the corresponding key 2. In this example, the key sensor 22 detects a depression amount of the key 2 and outputs, to the controller 10, the detection signal indicative of the detection result. It is noted that the key sensor 22 may be configured to output a detection signal indicating that the key 2 has passed a certain depression position, instead of outputting the detection signal in accordance with the depression amount of the key 2. The certain depression position is any position in a range from a rest position to an end position of the key 2. It is preferable that the certain depression position be provided in a plural number. The detection signal to be output from the key sensor 22 may be any signal as long as the signal enables the behavior of the key 2 to be recognized by the controller 10.

Hammer sensors 24 are provided so as to correspond to the respective hammers 4. Each hammer sensor 24 outputs, to the controller 10, a detection signal in accordance with a behavior of the corresponding hammer 4. In this example, the hammer sensor 24 detects a movement speed of the hammer 4 immediately before the hammer 4 strikes the string 5 and outputs, to the controller 10, the detection signal indicative of the detection result. The detection signal need not be a signal truly indicative of the movement speed of the hammer 4, but the movement speed may be calculated by the controller 10 as a detection signal obtained in any other arrangement. For instance, the detection signal to be output may be a signal indicating that the hammer shank has passed two certain positions during the movement of the hammer 4 or may be a signal indicating a time from a time point when the hammer shank has passed one of the two certain positions to a time point when the hammer shank has passed the other of the two certain positions. The detection signal to be output from the hammer sensor 24 may be any signal as long as the signal enables the behavior of the hammer 4 to be recognized by the controller 10.

Pedal sensors 23 are provided so as to correspond to the respective pedals 3. Each pedal sensor outputs, to the controller 10, a detection signal in accordance with a behavior of the corresponding pedal 3. In this example, the pedal sensor 23 detects a step-on amount of the pedal 3 and outputs, to the controller 10, the detection signal indicative of the detection result. The pedal sensor 23 may be configured to output a detection signal indicating that the pedal 3 has passed a certain step-on position, instead of outputting the detection signal in accordance with the step-on amount of the pedal 3. The certain step-on position is any position in a range from a rest position to an end position of the pedal. It is preferable that the certain step-on position be a position that enables distinction between the contact state in which the damper 8 and the string 5 are completely in contact with each other and the non-contact state in which the damper 8 and the string 5 are not in contact with each other. It is further desirable that a plurality of certain step-on positions be provided for detection of a half pedal state in addition. The detection signal to be output from the pedal sensor 23 may be any signal as long as the signal enables the behavior of the pedal 3 to be recognized by the controller 10.

As long as the controller 10 can specify, for each key 2 (key number), striking timing of the string 5 by the hammer 4 (key-on timing), a striking velocity, and timing of suppression of the vibration of the string 5 by the damper 8 (key-off timing), by the detection signals output from the key sensor 22, the pedal sensor 23, and the hammer sensor 24, the key sensor 22, the pedal sensor 23, and the hammer sensor 24 may be configured to output the detection results of the respective behaviors of the key 2, the pedal 3, and the hammer 4 as detection signals obtained in any other arrangement.

On a soundboard 7, soundboard ribs 75 and a bridge 6 are attached. Vibration of the soundboard 7 is transmitted to the strings 5 via the bridge 6 and vibration of the strings 5 is transmitted to the soundboard 7 via the bridge 6. On the soundboard 7, a soundboard acoustic transducer is installed. As will be later explained in detail, the soundboard acoustic transducer includes an acoustic transducer 30 for vibrating the soundboard 7. The acoustic transducer 30 is fixed by a fixture 40 to a back post 9 (as one example of a member) of the grand piano 1, and a drive member 39 is held in close contact with a lower surface of the soundboard 7. A drive signal is input to the acoustic transducer 30 from the controller 10. The drive member 39 vibrates in accordance with a waveform of the input drive signal, thereby vibrating the soundboard 7. The vibration of the soundboard 7 causes the bridge 6 to be vibrated. The soundboard 7 is a solid wooden plate member that is fixed at its outer peripheral portion to a side board of the grand piano 1. The soundboard 7 amplifies a middle and low-frequency component whereas the soundboard 7 offers a low amplification effect with respect to a high-frequency component including a high-order harmonic component though the soundboard 7 vibrates with respect to the high-frequency component. That is, the soundboard 7 functions as a bass amplifier. The soundboard 7 according to the embodiment and modifications (that will be explained) of the invention is a flat plate member made of wood (including solid wood, wood in which resin is contained, plywood in which a plurality of thin plates are laminated). The soundboard 7 is supported by a support member (as one example of a member) so as to be vibrated in a direction perpendicular to a plate surface thereof and has a function of amplifying, by vibration, a low-frequency component in the audible band of acoustic signals. For amplifying the low-frequency component in the audible band of the acoustic signals, the flat surface of the soundboard 7 has a relatively large area.

Figure 3:
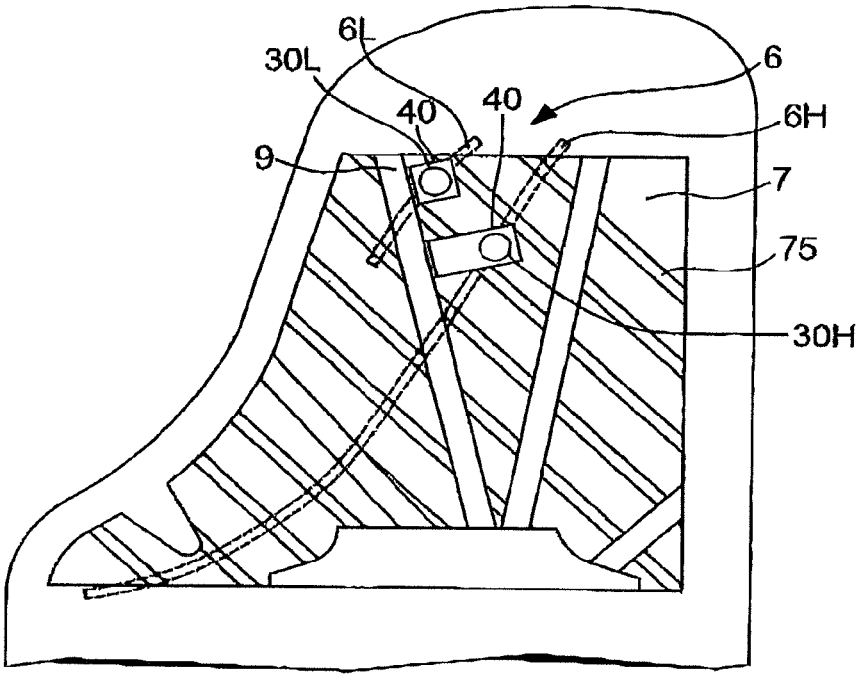
FIG. 3 is a view for explaining positions of acoustic transducers according to the embodiment of the invention.

FIG. 3 is a view for explaining a position of the acoustic transducer 30 according to the embodiment. In this example, two acoustic transducers 30H, 30L, each as the acoustic transducer 30, are provided. Hereinafter, where it is not necessary to distinguish the two acoustic transducers 30H, 30L from each other, the acoustic transducers 30H, 30L will be simply referred to as the acoustic transducer 30.

The acoustic transducer 30 is installed between adjacent two of the soundboard ribs 75 of the soundboard 7. The acoustic transducer 30H is provided at a position corresponding to one of two bridges 6 (a treble bridge 6H and a bass bridge 6L), namely, the bridge 6H. On the other hand, the acoustic transducer 30L is provided at a position corresponding to the bridge 6L. That is, the soundboard 7 is interposed between the acoustic transducer 30 and the bridge 6. The number of the acoustic transducers 30 provided on the soundboard 7 is not limited to two, but two or more acoustic transducers 30 or only one acoustic transducer 30 may be provided. Where only one acoustic transducer 30 is provided, the acoustic transducer 30 may be preferably provided at a position corresponding to the treble bridge 6H when two bridges 6 are provided.

The bridge 6H is for supporting the strings 5 in the treble (high) range while the bridge 6L is for supporting the strings 5 in the bass (low) range. Hereinafter, where it is not necessary to distinguish the two bridges 6H, 6L from each other, the bridges 6H, 6L will be simply referred to as the bridge 6. As described above, the acoustic transducer 30 is supported by the fixture 40 that is fixed to the back post 9.

Figure 4:
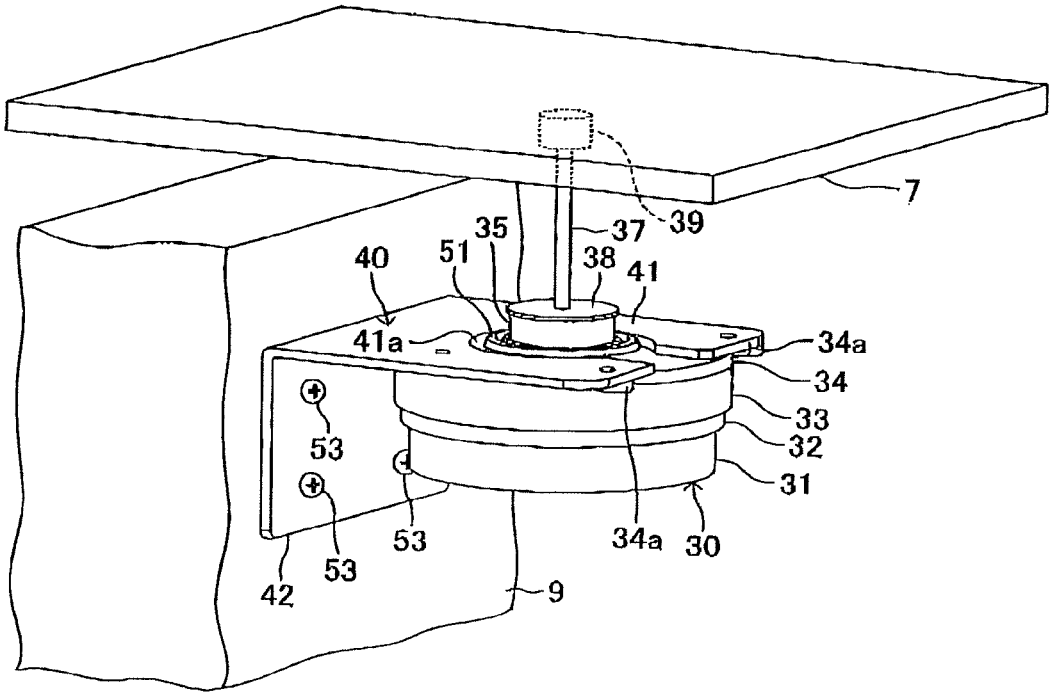
FIG. 4 is a perspective view of a soundboard acoustic transducer according to the embodiment of the invention.
Figure 5:
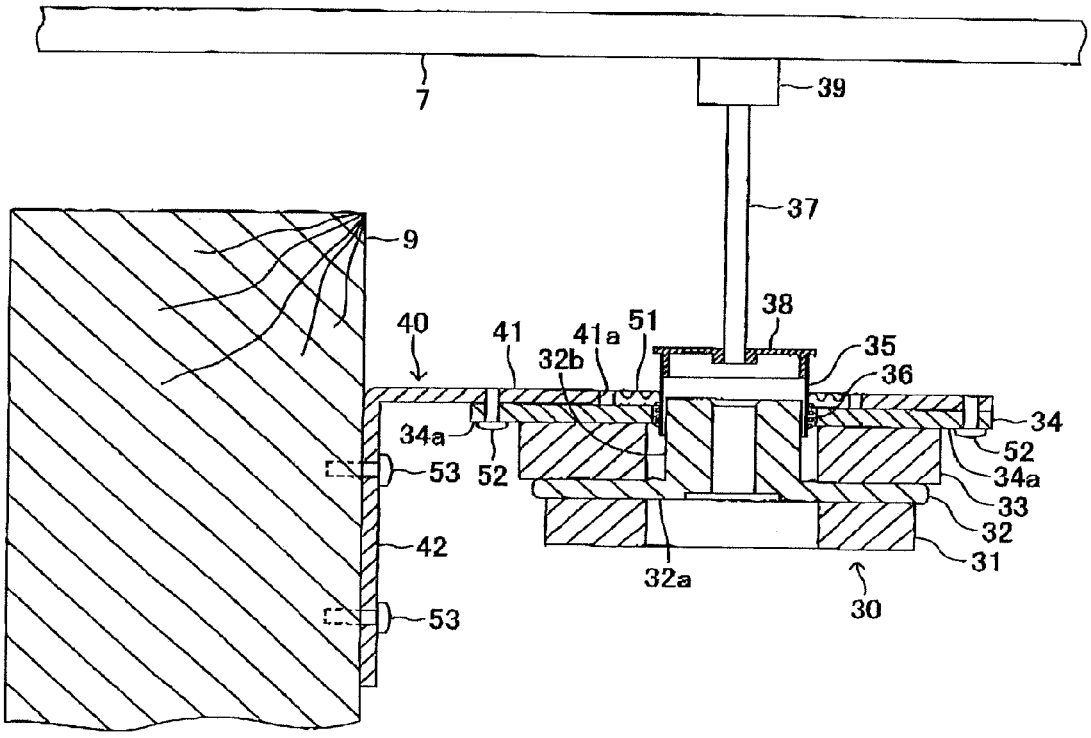
FIG. 5 is a front view of the soundboard acoustic transducer that is partly broken in FIG. 1.

The soundboard acoustic transducer will be explained in detail with reference to the drawings, FIG. 4 is a perspective view of the soundboard acoustic transducer according to the embodiment and FIG. 5 is a front view of the soundboard acoustic transducer that is partly broken. The soundboard acoustic transducer has the acoustic transducer 30 for vibrating the soundboard 7 and the fixture 40 by which the acoustic transducer 30 is supported with respect to the back post 9.

The acoustic transducer 30 is constituted by: a main body including magnets 31, 33 and yokes 32, 34; and a vibrator including a bobbin 35, a coil 36, and a drive rod 37. The magnet 31 has a cylindrical shape and is magnetized into the N pole and the S pole. The yoke 32 has a disc portion 32*a* having a disc-like shape and a cylindrical portion 32*b* that protrudes upward at a central position of the disc portion 32*a*. The yoke 32 is fixed at a lower surface of the disc portion 32*a* to an upper surface of the magnet 31. The magnet 33 also has a cylindrical shape and is magnetized into the N pole and the S pole. The magnet 33 is fixed at its lower surface to an upper surface of the disc portion 32*a* of the yoke 32 and has a central through-hole through which the cylindrical portion 32*b* of the yoke 32 passes. The yoke 34 has a disc-like shape having a central through-hole and is fixed at its lower surface to an upper surface of the magnet 33 while permitting the cylindrical portion 32*b* of the yoke 32 to pass through the central through-hole. The yoke 34 has extensions 34*a* formed at a plurality of locations of its outer circumferential surface for fixing the yoke 34 to the fixture 40.

The bobbin 35 has a cylindrical shape. The bobbin 35 is configured such that its lower portion is advanceable and retractable with respect to an annular space formed between an outer circumferential surface of the cylindrical portion 32*b* of the yoke 32 and inner circumferential surfaces of the magnet 33 and the yoke 34 that define the respective central through-holes. The coil 36 is wound around a lower outer circumferential surface of the bobbin 35. The bobbin 35 is supported by the yoke 34 via an annular damper 51 whose inner circumferential surface is fixed to the outer circumferential surface of the bobbin 35 and whose outer circumferential surface is fixed to an upper surface of the yoke 34. The damper 51 is formed of a diaphragm having elasticity and permits upward and downward vibration of the bobbin 35 (vibration of the bobbin 35 in the up-down direction) with respect to the yoke 34. A magnetic fluid may fill or need not fill between the inner circumferential surface of the yoke 34 defining the central through-hole and the coil 36.

A bobbin cap 38 is fixed to an inner circumferential surface of an upper opening of the bobbin 35. To a central portion of the bobbin cap 38, a lower end portion of the drive rod 37 is fixed. The drive rod 37 has a cylindrical shape, and the drive member 39 is attached to an upper end portion of the drive rod 37. The drive member 39 has a cylindrical shape having a diameter larger than that of the drive rod 37. An external thread portion formed at the upper end portion of the drive rod 37 is inserted from a lower surface side of the drive member 39, so that the drive member 39 is fixed by screwing to the upper end portion of the drive rod 37. The drive rod 37 and the drive member 39 may be connected to each other in various ways such as by using an adhesive and by press fitting, other than by screwing. Moreover, the drive member 39 and the drive rod 37 may be formed integrally with each other. The drive member 39 is closely fixed at its upper surface to a lower surface of the soundboard 7 by an adhesive, a double-sided adhesive tape or the like. In this respect, the drive member 39 may be in close contact with the lower surface of the soundboard 7 such that the upper surface of the drive member 39 is simply held in abutting contact with the lower surface of the soundboard 7 without being bonded, as long as the soundboard 7 can be vibrated by vibration of the drive member 39.

The fixture 40 is a plate-like member having a first flat plate portion 41 and a second flat plate portion 42. The fixture 40 is formed by bending, at an angle of substantially 90°, a metal plate having rigidity and capable of vibrating, such as an iron plate, a steel plate, a copper plate, an aluminum plate, or a stainless plate, so as to have an L-shaped cross-sectional shape. The thickness, the size, the shape, etc., of the metal plate that provides the first flat plate portion 41 and the second flat plate portion 42 are suitably determined. The fixture 40 formed of the metal plate (the first flat plate portion 41, in particular) is configured to vibrate in a perpendicular direction with respect to a plate surface of the fixture 40 (the first flat plate portion 41) in a high frequency range of 4 kHz-15 kHz. The first flat plate portion 41 has, at its central portion, a circular through-hole 41*a* having a diameter larger than that of the central through-hole of the yoke 34. The drive member 39, the drive rod 37, the bobbin cap 38, and the bobbin 35 of the acoustic transducer 30 are inserted, from below, through the through-hole 41*a* in an upward direction. The yoke 34, namely, the main body of the acoustic transducer 30, is fixed to the fixture 40 by screws 52 at locations of the extensions 34*a* of the yoke 34 with an upper surface of the yoke 34 held in close contact with a lower surface of the first flat plate portion 41. In this respect, instead of using the screws 62, the upper surface of the yoke 34 may be fixed by an adhesive to the lower surface of the first flat plate portion 41 of the fixture 40.

The second flat plate portion 42 of the fixture 40 is fixedly attached to the back post 9 by a plurality of screws 53. Also in this instance, the second flat plate portion 42 may be firmly fixed to the back post 9 by an adhesive, without using the screws 53. In this respect, the second flat plate portion 42 may be fixed to a structure member (such as a key bed, a back beam, or a sideboard) other than the back post 9, as long as the structure member (the support member) is other than the soundboard 7 and is located at a position near to the soundboard 7.

<Structure of Controller 10>

Figure 6:
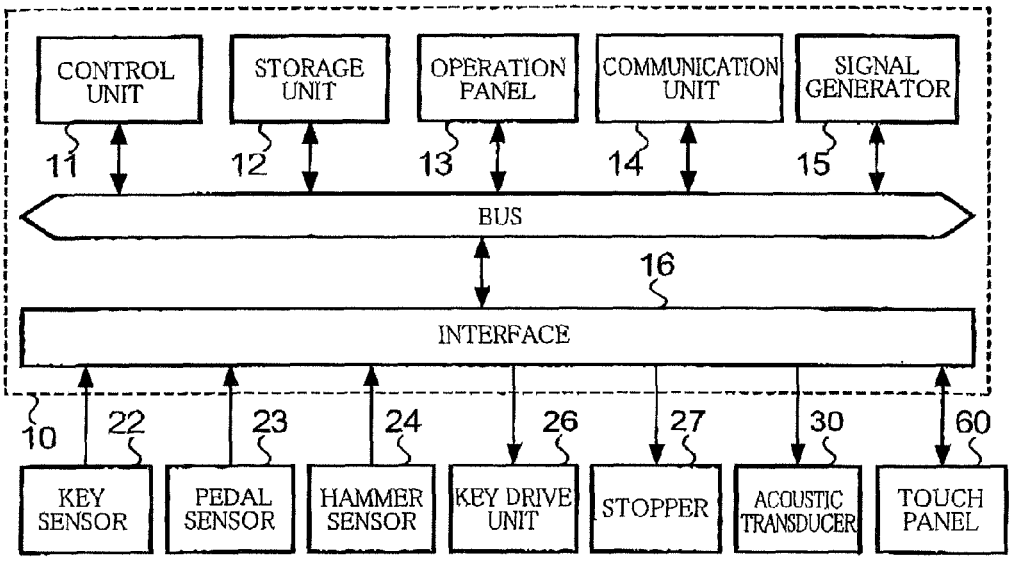
FIG. 6 is a block diagram showing a structure of a controller in the embodiment of the invention.

There will be explained a structure of the controller 10. FIG. 6 is a block diagram showing the structure of the controller 10 according to the embodiment of the invention. The controller 10 includes a control unit 11, a storage unit 12, the operation panel 13, a communication unit 14, a signal generator 15, and an interface 16 that are connected to one another via a bus. The control unit 11 includes an arithmetic unit such as a CPU (Central Processing Unit) and a storage unit such as a ROM (Read Only Memory) and a RAM (Random Access Memory). The control unit 11 is configured to control various portions of the controller 10 and various components connected to the interface 16, on the basis of a control program stored in the storage unit. In this example, the control unit 11 executes the control program, to thereby allow the controller 10 and a part of the portions connected to the controller 10 to function as a keyboard musical instrument.

The storage unit 12 stores setting information indicative of various settings to be used when the control program is being executed. The setting information is, for instance, information for determining details of a drive signal to be output from the signal generator 15, on the basis of the detection signals that are output from the key sensor 22, the pedal sensor 23, and the hammer sensor 24. The setting information includes information indicative of the sound generation mode and the performance mode set by the user.

The operation panel 13 includes operation buttons for receiving user's operations. When a user's operation is received through any of the operation buttons, an operation signal in accordance with the operation is output to the control unit 11. The touch panel 60 connected to the interface 16 has a display screen such as a liquid crystal display. On a surface of the display screen, a touch sensor is provided for receiving user's operations. On the display screen, there are displayed, under control of the control unit 11 via the interface 16, various sorts of information such as a setting change screen for changing details of the setting information stored in the storage unit 12, a setting screen for setting various modes, and a musical score. When a user's operation is received through the touch sensor, an operation signal in accordance with the operation is output to the control unit 11 via the interface 16. User's instructions to the controller 10 are input by user's operations received via the operation panel 13 and the touch panel 60.

The communication unit 14 is an interface for performing wireless or wired communication with other devices. There may be connected, to the interface, a disk drive for reading out various data recorded in a recording medium such as a DVD (Digital Versatile Disk) or a CD (Compact Disk) and outputting the read data. Data to be input to the controller 10 via the communication unit 14 include, for instance, music data used in automatic performance.

Figure 7:
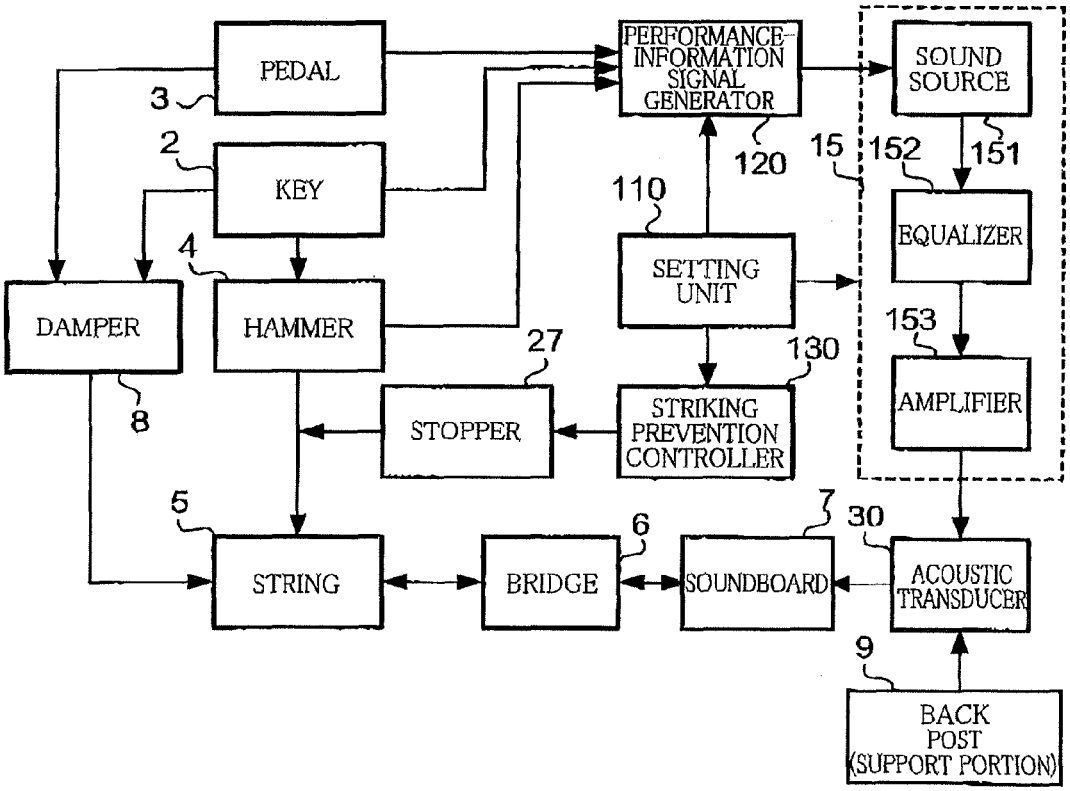
FIG. 7 is a block diagram showing a functional structure of the grand piano according to the embodiment of the invention.

The signal generator 15 includes a sound source 151 for outputting a musical instrument sound signal (as one example of a sound signal), an equalizer 152 for adjusting frequency characteristics of the musical instrument sound signal, and an amplifier 153 for amplifying the musical instrument sound signal, as shown in FIG. 7. The signal generator 15 is configured to output, as the drive signal, the musical instrument sound signal whose frequency characteristics are adjusted and which is amplified.

The interface 16 is for connecting the controller 10 and various external components. In this example, the components connected to interface 16 include the key sensor 22, the pedal sensor 23, the hammer sensor 24, the key drive unit 26, the stopper 27, the acoustic transducer 30, and the touch panel 60. The interface 16 outputs, to the control unit 11, the detection signals that are output from the key sensor 22, the pedal sensor 23, and the hammer sensor 24 and the operations signal that is output from the touch panel 60. The interface 16 outputs the control signal that is output from the control unit 11 to the key drive unit 26 and the stopper 27 and outputs the drive signal that is output from the signal generator 15 to the acoustic transducer 30.

<Functional Structure of Grand Piano 1>

There will be next explained a configuration realized by execution of the control program by the control unit 11. FIG. 7 is a block diagram showing a functional structure of the grand piano 1 according to the embodiment. As shown in FIG. 7, when the key 2 is operated, the hammer 4 strikes the string 5 and the string 5 is vibrated. The vibration of the string 5 is transmitted to the soundboard 7 via the bridge 6. Further, the damper 8 is actuated by an operation of the key 2 or an operation of the pedal 3. By the action of the damper 8, a suppression state of the vibration of the string 5 changes.

A setting unit 110 is realized by the touch panel 60 and the control unit 11 as a configuration having the following function. The touch panel 60 receives a user's operation for setting the sound generation mode. The control unit 11 changes the setting information in accordance with the performance mode and the sound generation mode set by the user and, in accordance with these modes, outputs a control signal indicative of the selected sound generation mode to a performance-information signal generator 120 and a striking prevention controller 130.

The touch panel 60 receives a user's operation for setting various control parameters in the signal generator 15. Various control parameters include parameters for determining a timbre (tone color) of musical sounds represented by the musical instrument sound signal output from the sound source 151, an adjustment fashion of the frequency characteristics in the equalizer 152, an amplification factor of the amplifier 153, and so on.

The control parameters may be individually set by the user. Alternatively, the control parameter may be set such that the user selects one of a plurality of sets of preset data for each of which values of the control parameter are set and which are pre-stored in the storage unit 12. The control unit 11 changes the setting information in accordance with the control parameters set by the user and controls the drive signal output from the signal generator 15 in accordance with the control parameters. In this respect, there may be employed a configuration in which the equalizer 152 and the amplifier 153 use only preset parameters and the parameter change by the control unit 11 is not performed.

The performance-information signal generator 120 is realized by the control unit 11, the key sensor 22, the pedal sensor 23, and the hammer sensor 24 as a configuration having the following function. Behaviors of the key 2, the pedal 3, and the hammer 4 are detected by the key sensor 22, the pedal sensor 23, and the hammer sensor 24. On the basis of the detection signals output as a result of the detection, the control unit 11 specifies striking timing of the string 5 by the hammer 4 (key-on timing), a number of the key 2 (key number) corresponding to the struck string 5, a striking velocity, and timing of suppression of the vibration of the string 5 by the damper 8 (key-off timing), as information to be utilized in the sound source 151 (i.e., performance information). In this example, the control unit 11 specifies the striking timing and the number of the key 2 from the behavior of the key 2, specifies the striking velocity from the behavior of the hammer 4, and specifies the vibration suppression timing from behaviors of the key 2 and the pedal 3. In this respect, the striking timing may be specified from the behavior of the hammer 4, and the striking velocity may be specified from the behavior of the key 2. Here, the performance information may be information represented by a control parameter in the MIDI (Musical Instrument Digital Interface) format, for instance.

The control unit 11 outputs, to the sound source 151, the performance information indicative of the key number, the velocity and the key on at the specified key-on timing. Further, the control unit 11 outputs, to the sound source 151, the performance information indicative of the key number and the key off at the specified key-off timing. The control unit 11 realizes the function described above when the sound generation mode set by the user is the weak sound mode or the strong sound mode, while, in this example, the control unit 11 does not output the performance information to the sound source 151 when the sound generation mode set by the user is the normal sound generation mode. When the sound generation mode set by the user is the normal sound generation mode, it is required that any drive signal be not output from the signal generator 15. Accordingly, even if the performance information is arranged to be output, it is just required for the control unit 11 to control the signal generator 15 such that no drive signals are output therefrom.

The striking prevention controller 130 is realized by the control unit 11 as a configuration having the following function. When the sound generation mode set by the user is the weak sound mode, the control unit 11 controls the stopper 27 to move to a position at which striking of the string 5 by the hammer 4 is prevented. On the other hand, when the sound generation mode set by the user is the normal sound generation mode or the strong sound mode, the controller 11 controls the stopper 27 to move to a position at which striking of the string 5 by the hammer 4 is not prevented.

The sound source 151 generates the musical instrument sound signal on the basis of the performance information output from the performance-information signal generator 120 (the control unit 11). For instance, the sound source 151 generates the musical instrument sound signal for providing a sound pitch corresponding to the key number and a sound volume corresponding to the velocity. As explained above, the frequency characteristics of the musical instrument sound signal are adjusted by the equalizer 152, and the musical instrument sound signal is subsequently amplified by the amplifier 153 and is thereafter output to the acoustic transducer 30 as the drive signal.

As described above, the acoustic transducer 30 vibrates in accordance with the drive signal input thereto, so that the acoustic transducer 30 causes the bridge 6 to be vibrated via the soundboard 7. The acoustic transducer 30 is supported by the back post 9 (the support portion). Accordingly, the vibration of the bridge 6 is transmitted to the strings 5. The functional structure of the grand piano 1 has been explained hereinabove.

<Operation Example>

There will be explained an operation example of the grand piano 1 according to the embodiment of the invention. Initially, the user operates the touch panel 60 to set the normal performance mode as the performance mode and to set the weak sound mode as the sound generation mode. In this state, when the user operates the key 2 and the pedal 3 for performance, striking of the string 5 by the hammer 4 is prevented by the stopper 27 while the soundboard 7 is vibrated by the acoustic transducer 30, so that sounds are emitted from the soundboard 7. Further, the bridge 6 is vibrated via the soundboard 7, so that other strings 5 which are not prevented by the dampers 8 from being vibrated also vibrate so as to generate sounds close to those of acoustic pianos. In this instance, the striking of the string 5 by the hammer 4 is prevented by the stopper 27, no sounds are generated by the string striking. Therefore, by adjusting the amplitude of the vibration of the acoustic transducer 30, it is possible to generate sounds utilizing acoustic effects by vibration of the soundboard 7 and resonance of the strings as in acoustic pianos, with a smaller volume (or a larger volume) than sounds generated by the string striking.

When the user operates the touch panel 60 to set the normal sound generation mode as the sound generation mode while the normal performance mode is maintained as the performance mode, excitation of the soundboard 7 by the acoustic transducer 30 is not carried out (namely, the acoustic transducer 30 does not cause the soundboard 7 to be vibrated) and the striking of the string 5 by the hammer 4 is not prevented. Accordingly, sounds are generated by the string striking, and the vibration of the string 5 is transmitted to the soundboard 7 via the bridge 6. The soundboard 7 emits sounds in accordance with the vibration of the string 5 transmitted thereto. In this instance, the soundboard 7 undergoes only a load of the vibrator that is a very light-weight portion in the acoustic transducer 30. Accordingly, the acoustic transducer 30 hardly influences the vibration characteristics of the soundboard 7, and the user can perform without impairing original acoustic property of acoustic pianos.

When the user operates the touch panel 60 to set the strong sound mode as the sound generation mode while the normal performance mode is maintained as the performance mode, excitation of the soundboard 7 by the acoustic transducer 30 and the striking of the string 5 by the hammer 4 are simultaneously carried out. Accordingly, the soundboard 7 emits sounds by vibration in which are added vibration of the string 5 by striking transmitted to the soundboard 7 via the bridge 6 and vibration of the soundboard 7 by the acoustic transducer 30. Further, the string 5 that has been struck by the hammer 4 emits sounds and other strings 5 which are not prevented by the dampers 8 from being vibrated vibrate in accordance with the vibration of the soundboard 7 via the bridge 6, thereby generating resonance sounds. Therefore, the user can perform with sounds in which original acoustic piano sounds and sounds represented by the musical instrument sound signal generated from the sound source 151 are naturally mixed.

When the automatic performance mode is set as the performance mode, the control unit 11 drivingly controls the key drive unit 26 based on the automatic performance data, and the key drive unit 26 drives the key 2 in a manner similar to the above-described operation by the user. Accordingly, the grand piano 1 generates the musical instrument sounds indicated above in accordance with any one of the weak sound mode, the normal sound generation mode, and the strong sound mode that is set by the user. In the automatic performance mode, when the sound generation mode is the weak sound mode or the strong sound mode, the automatic performance data may be supplied directly to the sound source 151 for permitting the sound source 151 to generate the musical instrument sound signal based on the automatic performance data, and the acoustic transducer 30 may be drivingly controlled by the generated musical instrument sound signal. The generation of the musical instrument sound signal by the sound source 151 using the automatic performance data is effective particularly when the sound generation mode is the weak sound mode because the striking of the string 5 by the hammer 4 is prevented by the striking prevention controller 130 and the stopper 27 in the weak sound mode.

There will be explained in detail generation of piano sounds (or sounds of other musical instruments) in a case where the sound generation mode is set to the weak sound mode or the strong sound mode, namely, where the soundboard 7 is vibrated by the acoustic transducer 3, in a state in which the performance mode is set to the normal performance mode or the automatic performance mode. On the basis of performance operation information by performance by the user or by the automatic performance data, the sound source 151 outputs an electric musical instrument sound signal indicative of piano sounds (or sounds of other musical instruments) to the coil 36 of the acoustic transducer 30 via the amplifier 153. As a result, in the acoustic transducer 30, the bobbin 35 and the bobbin cap 38 are vibrated in the up-down direction with respect to the main body constituted by the magnets 31, 33 and the yokes 32, 34 in accordance with the musical instrument sound signal. The vibration of the bobbin 35 and the bobbin cap 38 is transmitted to the drive member 39 via the drive rod 37, and the drive member 39 causes the soundboard 7 to be vibrated in the up-down direction in accordance with the musical instrument sound signal. Owing to the vibration of the soundboard 7, the musical instrument sound signal is converted into the acoustic signal, and the performer and listeners hear musical instrument sounds (performance sounds) corresponding to the operations of the keys 2 and the pedal 3 by the performer. The musical instrument sounds by the vibration of the soundboard 7 by means of the acoustic transducer 30 are musical instrument sounds in a smaller volume than a volume of sounds generated when the string is vibrated by the hammer 4, namely, weak musical instrument sounds.

On the other hand, the main body of the acoustic transducer 30 constituted by the magnets 31, 33 and the yokes 32, 34 also vibrate in a direction perpendicular to the plate surface of the main body, i.e., in the up-down direction in the FIGS. 4 and 5, owing to counteraction of the force by which the bobbin 35 is driven. In this condition, the second flat plate portion 42 of the fixture 40 is fixed to the back post 9 while the first flat plate portion 41 of the fixture 40 is closely fixed at its lower surface to the upper surface of the yoke 34 of the main body of the acoustic transducer 30. Because the first flat plate portion 41 is constituted by the metal plate that can vibrate, the first flat plate portion 41 also vibrates with respect to the second flat plate portion 42 and the back post 9. Accordingly, sounds by the vibration of the first flat plate portion 41 are also emitted together with sounds by the vibration of the soundboard 7. The first flat plate portion 41 formed of the metal plate is readily to vibrate in response to the high frequency component of the musical instrument sound signal, and sounds by the vibration of the first flat plate portion 41 sufficiently include the high-frequency component of the musical instrument sounds to be generated. More specifically, because the metal plate is configured to vibrate at a high frequency in a range of 4 kHz-15 kHz, musical instrument sounds by the vibration of first flat plate portion 41 sufficiently include the high-frequency component in the range of 4 kHz-15 kHz. According to the embodiment, therefore, even if musical instrument sounds by the vibration of the soundboard 7 is insufficient in the high-frequency component, the vibration of the first flat plate portion 41 complements the high-frequency component, so that musical instrument sounds that sufficiently include the high-frequency component are generated. Accordingly, the performer and people who are present near the performer can hear good musical instrument sounds.

In carrying out the present invention, it is to be understood that the present invention is not limited to the details of the embodiment described above, but may be embodied with other various changes without departing from the spirit and the object of the invention.

<First Modification Through Fifth Modification>

Figure 8:
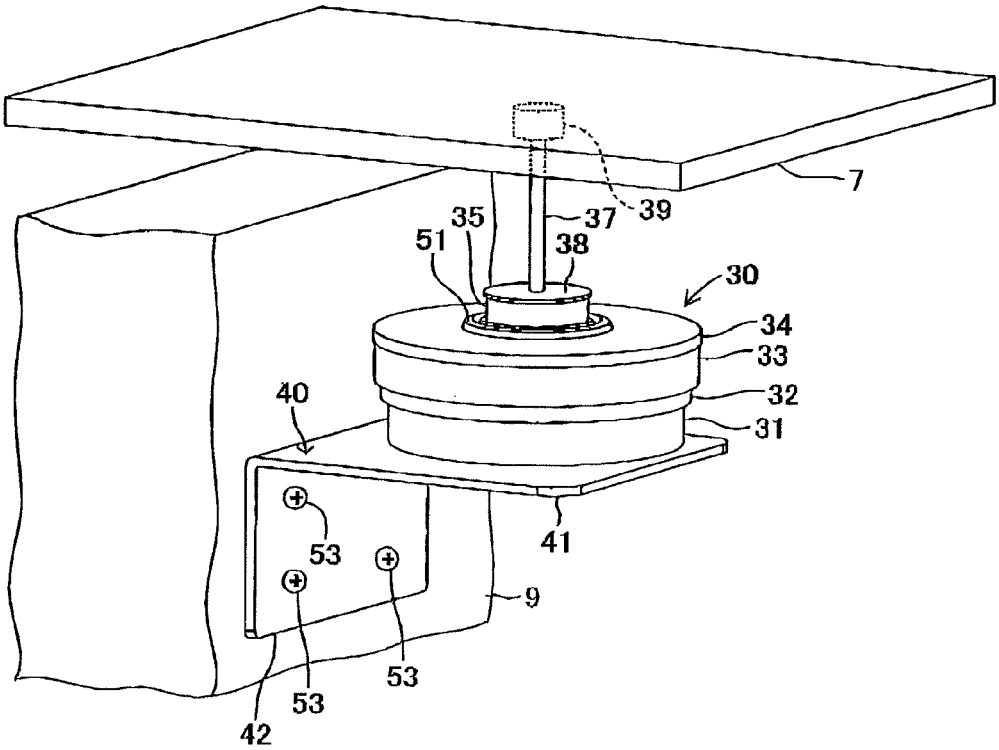
FIG. 8 is a perspective view of a soundboard acoustic transducer according to a first modification of the embodiment.

There will be next explained first through fifth modifications relating to a method of fixing the main body of the acoustic transducer 30 to the back post 9 in the embodiment illustrated above. Initially, the first modification will be explained. As shown in FIG. 8, in the first modification, the main body of the acoustic transducer 30 is fixed to the upper surface of the first flat plate portion 41 of the fixture 40. In this instance, the magnet 31 is closely fixed at its lower surface to the upper surface of the first flat plate portion 41.

As the fixing method, the magnet 31 may be fixed at its lower surface to the upper surface face of the first flat plate portion 41 by an adhesive. Alternatively, a screw may be inserted from the lower surface of the first flat plate portion 41 to the lower surface of the magnet 31. In this modification, it is not necessary to permit the bobbin 35 and the bobbin cap 38 to pass through the first flat plate portion 41. Accordingly, the through-hole 41*a* formed in the first flat plate portion 41 in the embodiment illustrated above is not necessary. This is true of the following second through fourth modifications. Other structures in this modification are the same as the embodiment illustrated above.

Also in the first modification as described above, along with the vibration of the soundboard 7, the first flat plate portion 41 vibrates with respect to the second flat plate portion 42 and the back post 9. Accordingly, also in the first modification, the high-frequency component of the musical sound signal is complemented by the vibration of the first flat plate portion 41 as in the embodiment illustrated above, whereby advantages similar to those in the embodiment illustrated above are ensured.

Figure 9:
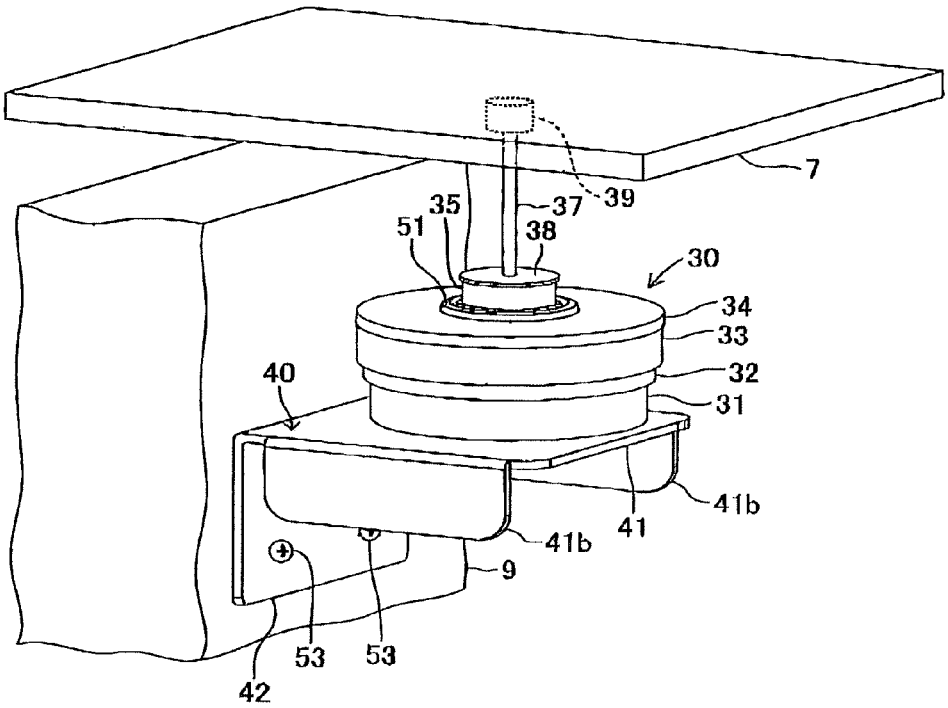
FIG. 9 is a perspective view of a soundboard acoustic transducer according to a second modification of the embodiment.

The second modification will be explained. As shown in FIG. 9, also in the second modification, the main body of the acoustic transducer 30 is fixed to the upper surface of the first flat plate portion of the fixture 40 such that the magnet 31 and the first flat plate portion 41 are closely fixed to each other. In the second modification, however, extending portions 41*b*, 41*b* are provided on the lower surface of the first flat plate portion 41. Each of the extending portions 41*b*, 41*b* is constituted by a rectangular metal plate that is formed of the same material as the metal plate of the first flat plate portion 41. The extending portion 41*b* is connected at its upper end integrally to the first flat plate portion 41, so as to protrude or extend downward, namely, in a substantially perpendicular direction with respect to the surface of the first flat plate portion 41. The extending portions 41*b*, 41*b* may be formed by bending respective end portions of the first flat plate portion 41 or may be connected to respective end portions of the first flat plate portion 41 by welding. Other structures in this modification are the same as the first modification described above. Each extending portion 41*b*, 41*b* extends in a direction in which the first flat plate portion 41 extends from the second flat plate portion 42, namely, in a direction away from the back post 9. Because the fixture 40 has the L-shaped cross-sectional shape as described above, the surface of the first flat plate portion 41 extends in a substantially perpendicular direction with respect to the surface of the second flat plate portion 42. Accordingly, the extending portion 41*b* is formed such that the surface of the extending portion 41*b* extends in a substantially perpendicular direction with respect to the surface of the second flat plate portion 42. Further, the extending portions 41*b*, 41*b* are provided so as to be spaced apart from the second flat plate portion 42. That is, the extending portions 41*b*, 41*b* are not directly supported by the second flat plate portion 42.

Figure 10:
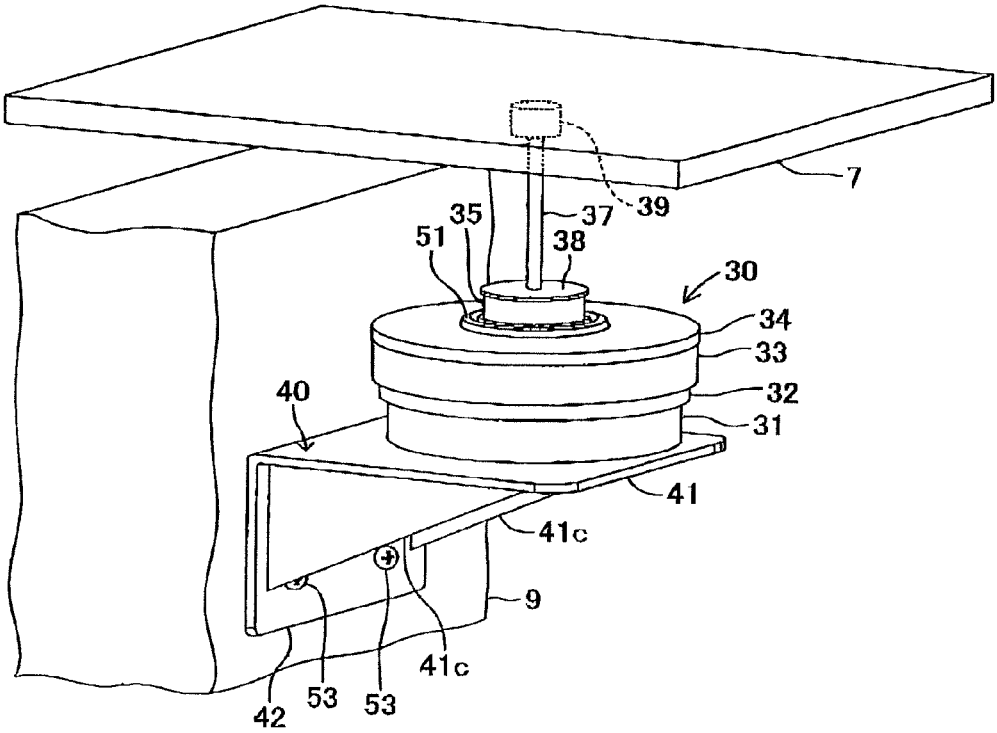
FIG. 10 is a perspective view of a soundboard acoustic transducer according to a third modification of the embodiment.

Referring next to FIG. 10, the third modification will be explained. In the third modification, extending portions 41*c*, 41*c* each having a triangular shape are employed in place of the extending portions 41*b*, 41*b* in the second modification. Other structures in this modification are the same as the second modification described above. Like the extending portion 41*b*, 41*b*, the extending portions 41*c*, 41*c* are provided so as to be spaced apart from the second flat plate portion 42.

In the second and third modifications described above, the two extending portion 41*b*, 41*b* are provided so as to be in parallel to each other and the two extending portions 41*c*, 41*c* are provided so as to in parallel to each other, so as to extend or protrude in the downward direction perpendicularly with respect to the first flat plate portion 41. The two extending portions 41*b*, 41*b* need not be in parallel to each other and the two extending portions need not be in parallel to each other. Further, the extending portions 41*b*, 41*b* and the extending portions 41*c*, 41*c* may extend or protrude downward at an angle not perpendicular to the first flat plate portion 41. In a case where the extending portions 41*b*, 41*b* and the extending portions 41*c*, 41*c* are connected to the first flat plate portion 41 by welding, the extending portions 41*b*, 41*b* and the extending portions 41*c*, 41*c* may be attached to various positions on the lower surface of the first flat plate portion 41. The extending portions 41*b*, 41*b* and the extending portions 41*c*, 41*c* may have any shape other than the rectangular shape and the triangular shape. The number of the extending portions 41*b*, 41*b* and the number of the extending portions 41*c*, 41*c* may be one or three or more. Moreover, the extending portions 41*b*, 41*b* in the second modification and the extending portions 41*c*, 41*e* in the third modification may be provided on the upper surface of the first flat plate portion 41.

Also in the second and third modifications described above, along with the vibration of the soundboard 7, the first flat plate portion 41 vibrates with respect to the second flat plate portion 42 and the back post 9, and the extending portions 41*b*, 41*b* and the extending portions 41*c*, 41*c* also vibrate. Accordingly, as in the embodiment illustrated above, in the second and third modifications, the high-frequency component of the musical instrument sound signal is complemented or added by the vibration of the extending portions 41*b*, 41*b* or the extending portions 41*c*, 41*c*, in addition to the vibration of the first flat plate portion 41, so that advantages similar to those in the illustrated embodiment are expected. Further, in the second and third modifications, the extending portions 41*b*, 41*b* and the extending portions 41*c*, 41*c* vibrate in a direction different from the direction in which the first flat plate portion 41 vibrates. Accordingly, sounds that consist of the high-frequency component of the musical instrument sound signal by the vibration of the first flat plate portion 41 and the vibration of the extending portions 41*b*, 41*b* or the extending portions 41*c*, 41*c* propagate in various directions, so that the acoustic characteristics of the musical instrument sounds become much better as compared with those in the illustrated embodiment. Moreover, the extending portions 41*b*, 41*b* or the extending portions 41*c*, 41*c* ensure the rigidity of the first flat plate portion 41, so that the thickness of the first flat plate portion 41 can be reduced, resulting in a weight reduction of the fixture 40.

Figure 11:
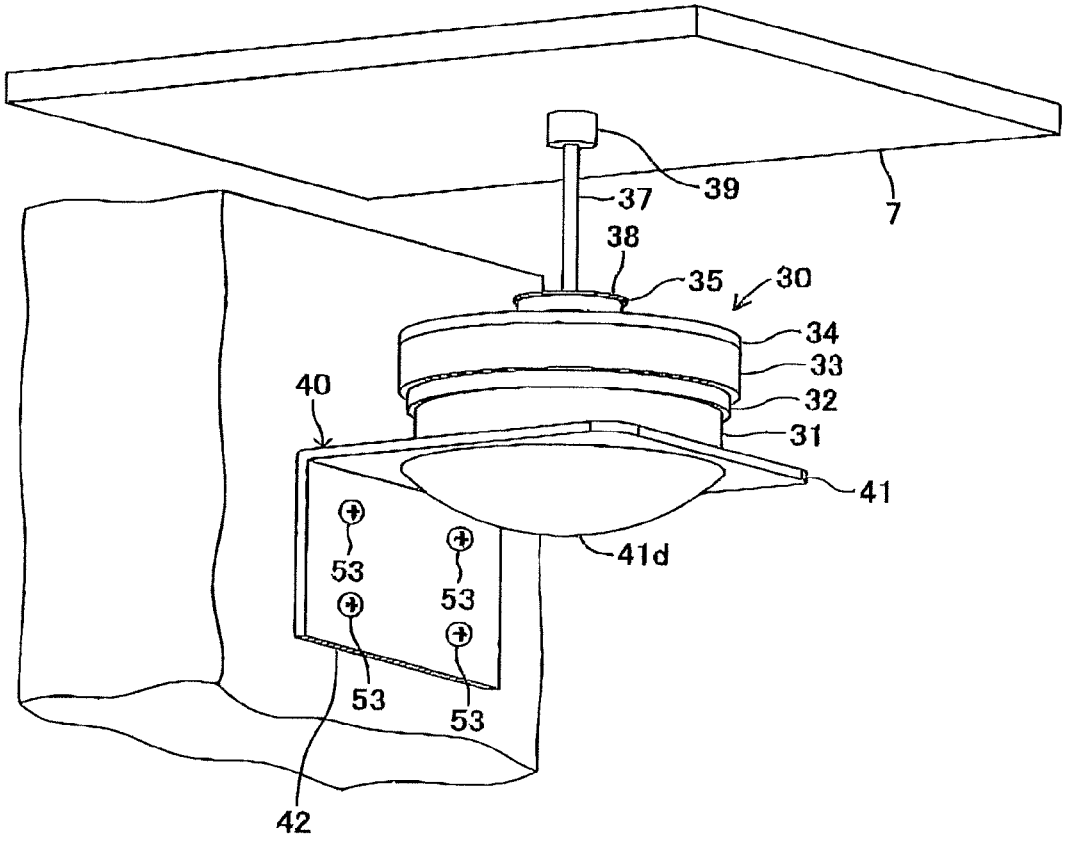
FIG. 11 is a perspective view of a soundboard acoustic transducer according to a fourth modification of the embodiment.

Referring next to FIG. 11, the fourth modification will be explained. In the fourth modification, there is provided, on the first flat plate portion 41 of the fixture 40 in the first modification, a protrusion 41*d* by modifying a part of the first flat plate portion 41. The protrusion 41*d* having a circular or oval cross-sectional shape protrudes downward. Other structures in this modification are the same as the first modification. In the fourth modification, only one protrusion 41*d* is provided, but a plurality of protrusions similar to the protrusion 41*d* may be provided.

Also in the fourth modification described above, along with the vibration of the soundboard 7, the first flat plate portion 41 vibrates with respect to the second flat plate portion 42 and the back post 9. Accordingly, as in the embodiment and the first through third modifications described above, the high-frequency component of the musical instrument sound signal is complemented or added by the vibration of the first flat plate portion 41 in the fourth modification, so that advantages similar to those in the illustrated embodiment are ensured. Further, in the fourth modification, the protrusion 41*d* of the first flat plate portion 41 permits sounds that consist of the high-frequency component of the musical instrument sound signal to propagate in various directions, so that the acoustic characteristics of the musical instrument sounds become much better as compared with those in the embodiment and the first through third modifications described above.

In the second and third modifications, the extending portions 41*b*, 41*c* are provided on the lower surface of the first flat plate portion 41 with the acoustic transducer 30 closely fixed to the upper surface of the first flat plate portion 41 of the fixture 40. In the fourth modification, the downwardly protruding protrusion 41*d* is provided on the lower surface of the first flat plate portion 41 with the acoustic transducer 30 closely fixed to the upper surface of the first flat plate portion 41 of the fixture 40. In this respect, extending portions similar to the extending portions 41*b*, 41*c* may be provided on the upper surface of the first flat plate portion 41 with the acoustic transducer 30 closely fixed to the lower surface of the first flat plate portion 41 of the fixture 40 as in the illustrated embodiment. Further, a protrusion similar to the protrusion 41*d* may be provided so as to protrude upward from the first flat plate portion 41 with the acoustic transducer 30 closely fixed to the lower surface of the first flat plate portion 41 of the fixture 40 as in the illustrated embodiment. In this instance, however, it is necessary to increase the area of the first flat plate portion 41 as compared with that in the illustrated embodiment for forming the protrusion thereon.

Figure 12:
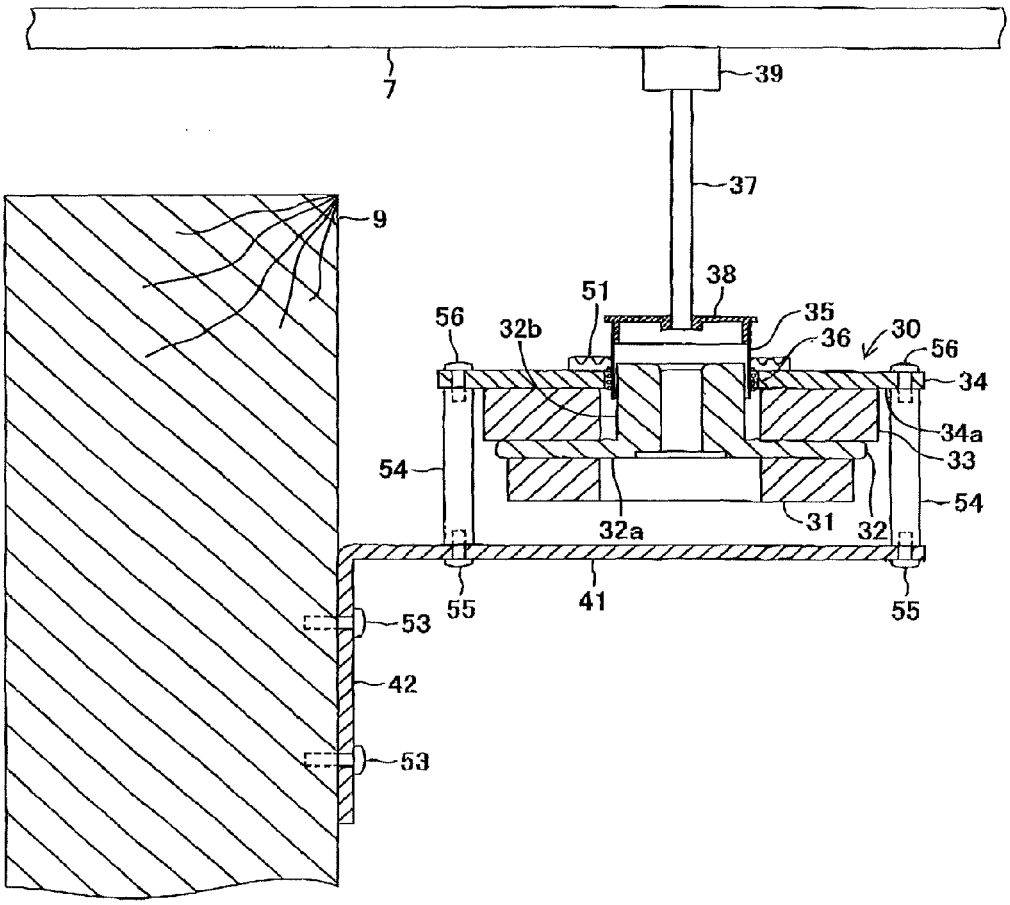
FIG. 12 is a perspective view of a soundboard acoustic transducer according to a fifth modification of the embodiment.

Referring next to FIG. 12, the fifth modification will be explained. In the fifth embodiment, the acoustic transducer 30 is not fixed directly to the first flat plate portion 41 of the fixture 40, but is fixed via support members. Also in the fifth modification, the fixture 40 is a metal, plate constituted by the first flat plate portion 41 and the second flat plate portion 42 so as to have an L-shaped cross-sectional shape as in the illustrated embodiment. The fixture 40 is fixed at the second flat plate portion 42 to the back post 9 by screws 53. Also in this modification, the first flat plate portion 41 is a simple flat plate without having the through-hole 41*a* that is provided in the first flat plate portion 41 in the illustrated embodiment.

In the fifth modification, the acoustic transducer 30 is fixed onto the first flat plate portion 41 via a plurality of (e.g., four) cylindrical columnar support members 54 formed of metal or resin. That is, lower end faces of the support members 54 are held in close contact with the upper surface of the first flat plate portion 41, and screws 55 are inserted into the support members 54 from the lower surface side of the first flat plate portion 41, whereby the support members 54 are fixed to the upper surface of the first flat plate portion 41 so as to extend upright. Further, the lower surfaces of the extensions 34*a* of the yoke 34 of the acoustic transducer 30 are held in close contact with upper end faces of the support members 54, and screws 56 are inserted into the support members 54 from the upper surface side of the extensions 34*a*, whereby the yoke 34 is fixed to the upper end faces of the support members 54. Other structures in this modification are the same as the illustrated embodiment. In this modification, the support members 54 may be fixed to the upper surface of the first flat plate portion 41 and the yoke 34 may be fixed to the upper end faces of the support members 54 using an adhesive, instead of using the screws 55, 56. While the cylindrical columnar member is used as each support member 54, there may be used, as the support member 54, a hollow cylindrical member, a polygonal columnar member, or a hollow member with a polygonal cross-section. In relation to the support member 54, the frequency characteristics in the vibration of the fixture 40 are desirably determined by considering the frequency characteristics of the vibration of the support member 54.

Also in the fifth modification, the vibration characteristics of the first flat plate portion 41 may be adjusted by providing, on the first flat plate portion 41, the extending portions 41*b* in the second modification, the extending portions 41*c* in the third modification or the protrusion 41*d* in the fourth modification.

<Sixth Modification>

In the embodiment and the first through fifth modifications described above, the present invention is applied to the grand piano 1. The present invention is applicable to an upright piano.

Figure 13:
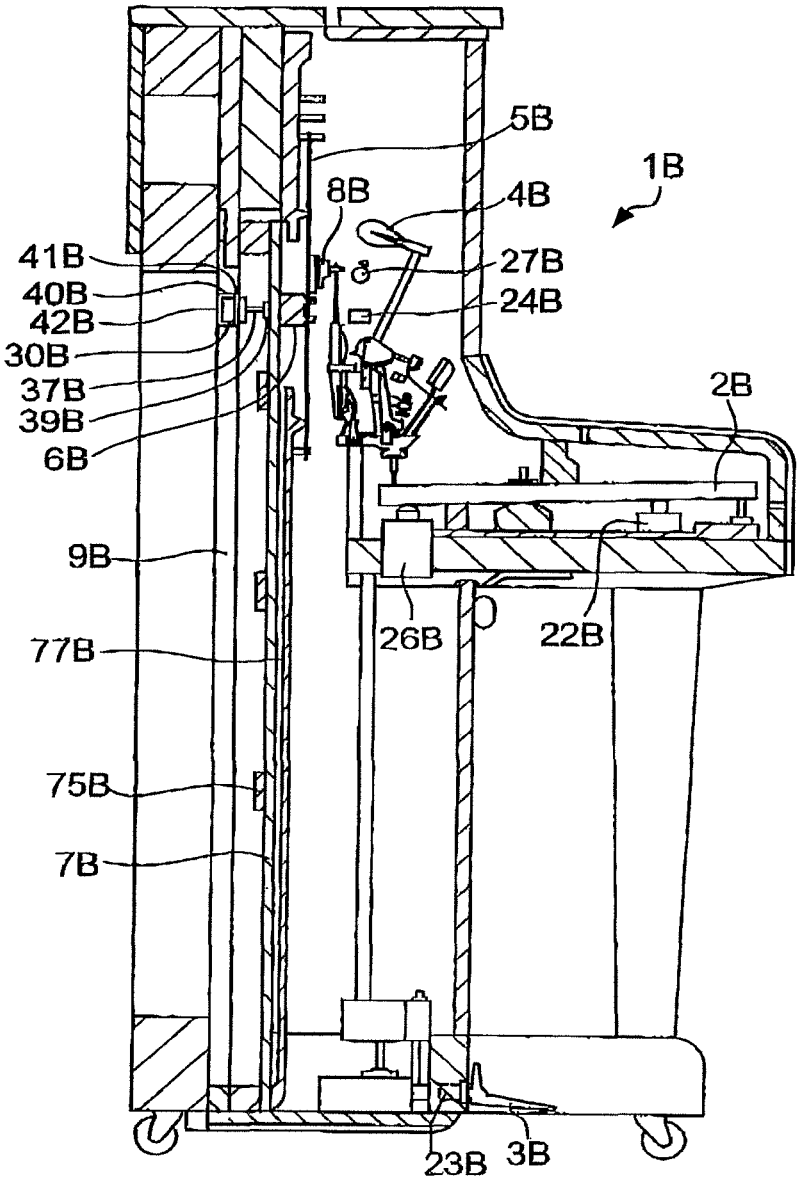
FIG. 13 is a view showing an internal structure of an upright piano according to a sixth modification of the embodiment.

FIG. 13 is a view showing an internal structure of an upright piano 1B according to the sixth modification of the present invention. In FIG. 13, components in the upright piano 1B are indicated by the same reference numerals, but together with "B", as used in the illustrated embodiment to identify the corresponding components in the grand piano 1 of the embodiment. Also in the upright piano 1B, the drive member 39B in the acoustic transducer 30B is held in close contact with the soundboard 7B, and the fixture 40B is fixedly supported by the back post 9B. In FIG. 13, the reference numeral 77B denotes a metallic frame that supports the strings 5B. The frame 77B has space in its plate surface.

Figure 14:
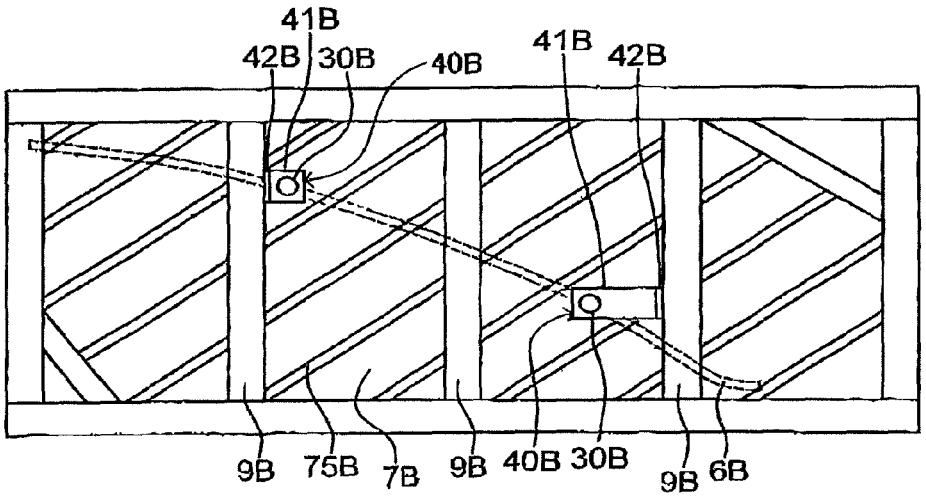
FIG. 14 is a view for explaining positions of the acoustic transducers according to the sixth modification of the embodiment.

FIG. 14 is a view for explaining positions of the two acoustic transducers 30B according to the sixth modification. As in the illustrated embodiment, each acoustic transducer 30B is disposed adjacent two of the soundboard rib 75B. Also in the sixth modification, each acoustic transducer 30B is provided at a position corresponding to the bridge 6B, in other words, at a position corresponding to the bridge 6B on one surface of the soundboard 7B to which the soundboard ribs 75 are attached. The fixture 40B is fixed at its second flat plate portion 42B to the back post 9B. Here, while each acoustic transducer 30B is provided at a position corresponding to the treble bridge of the bridges 6B, the acoustic transducer 30B may be provided at a position corresponding to the bass bridge (not shown). Alternatively, the acoustic transducers 30B may be provided at respective positions corresponding to one and the other of the treble bridge and the bass bridge. In FIG. 14, the two acoustic transducers 30B are provided. One acoustic transducer 30B or three or more acoustic transducers 30B may be provided. As the acoustic transducers 30B and the fixture 40B, the acoustic transducer 30 and the fixture 40 in the illustrated embodiment may be used or the acoustic transducer 30 and the fixture 40 in the first through fifth modifications may be used.

<Seventh Modification>

In the embodiment and the first through sixth modifications described above, the acoustic transducer 30, 30B is provided at the position on the soundboard 7, 7B corresponding to the bridge 6, 6B. The acoustic transducer 30, 30B may be provided at a position distant from the bridge 6, 6B.

Figure 15:
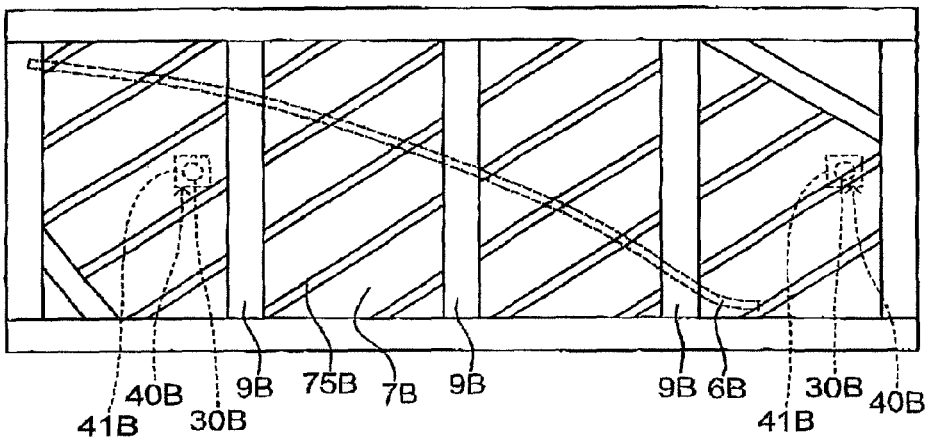
FIG. 15 is a view for explaining positions of the acoustic transducers according to a seventh modification of the embodiment.

FIG. 15 is a view showing an example in which the acoustic transducer 30B and the fixture 40B are disposed at a position distant from the bridge 6B of the soundboard 7B, by modifying the upright piano 1B according to the sixth modification shown in FIGS. 13 and 14. In the example of FIG. 15, each of the two acoustic transducers 30B and each of the two fixtures 40B are disposed, on one surface of the soundboard 7B to which the bridge 6B is attached (on the backside surface in FIG. 15), at a position at which the acoustic transducer 30B and the fixture 40B are opposed to the soundboard rib 75B, at a position in the vicinity of the soundboard rib 75B, or at a position somewhat distant from the soundboard rib 75B, with the soundboard 7*b* interposed therebetween. In this instance as well, there may be employed, as the acoustic transducer 30B and the fixture 40B, the acoustic transducer 30 and the fixture 40 in the illustrated embodiment or the acoustic transducer 30 and the fixture 40 in the first through fifth modifications. While, in FIG. 16, the two acoustic transducers 30B are provided, one acoustic transducer 30B or three or more acoustic transducers 30B may be provided.

Figure 16:
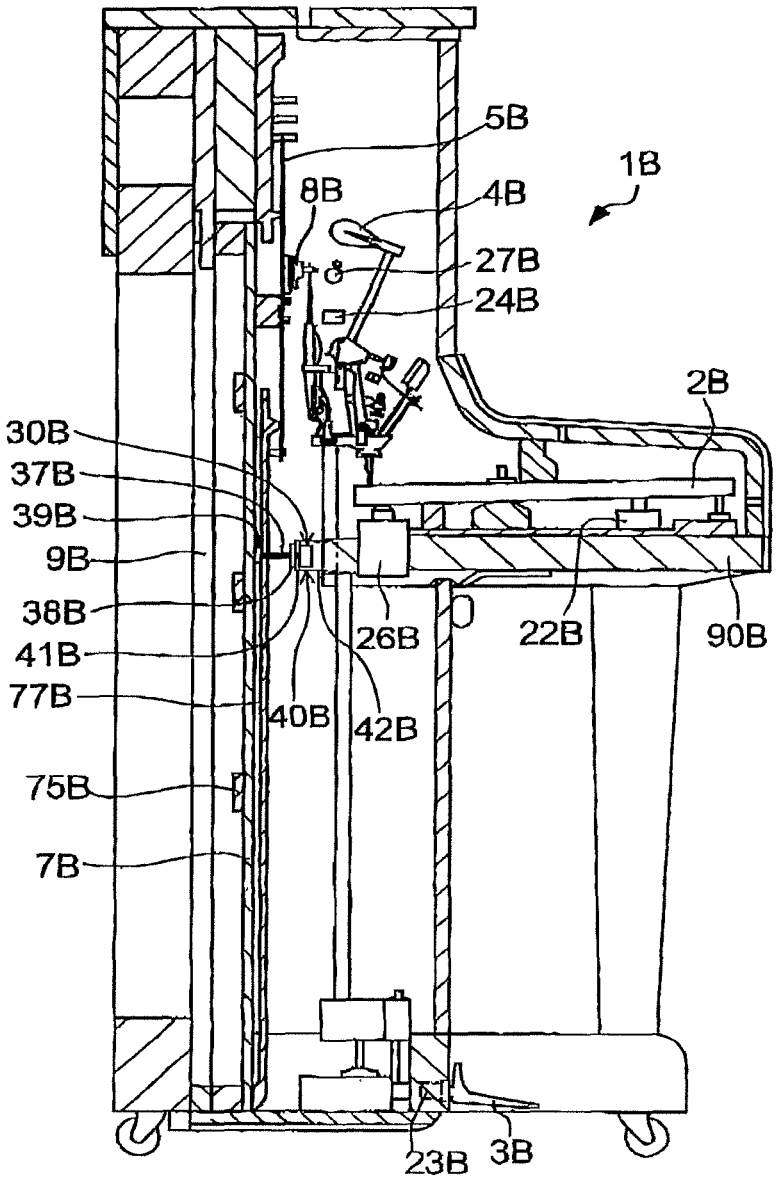
FIG. 16 is a view showing an internal structure of an upright piano according to the seventh modification of the embodiment.

FIG. 16 is a view showing a state in which the acoustic transducer 30B shown in FIG. 15 is supported by the key bed 90B of the upright piano 1B. As shown in FIG. 16, the fixture 40B in this modification is installed on a back surface portion of the key bed 90B such that the second flat plate portion 42B is fixed to the back surface portion of the key bed 90B by screwing or by using an adhesive. The drive rod 37B of the acoustic transducer 30B passes through the space of the frame 77B, and the drive member 39B is held in close contact with the backside surface of the soundboard 7B to which the bridge 6B is attached.

As explained above in the seventh modification, in a case where the acoustic transducer 30B is provided not at the position corresponding to the bridge 6B, but at the position at which the acoustic transducer 30B is opposed to the soundboard rib 75B or at the position in the vicinity of the soundboard rib 75B, excitation by the acoustic transducer 30B is efficiently transmitted to the entirety of the soundboard 7B owing to the soundboard rib 75B, ensuring desirable sound emission by the soundboard 7B. Further, an excitation rod that is a rod-like member different from the soundboard rib 75B may be attached to one surface of the soundboard 7B that is opposite to another surface to which the soundboard rib 75B is attached, and the acoustic transducer 30B may be disposed at a position corresponding to the excitation rod with the soundboard 7B interposed therebetween. In this instance, the excitation rod can be designed separately from the existing bridge 6B and soundboard rib 75B. Accordingly, it is desirable to adjust the shape, the size, the layout and so on of the excitation rod such that sounds having desirable acoustic characteristics are emitted from the soundboard 7B in accordance with excitation by the acoustic transducer 30B.

<Eighth Modification>

Figure 17:
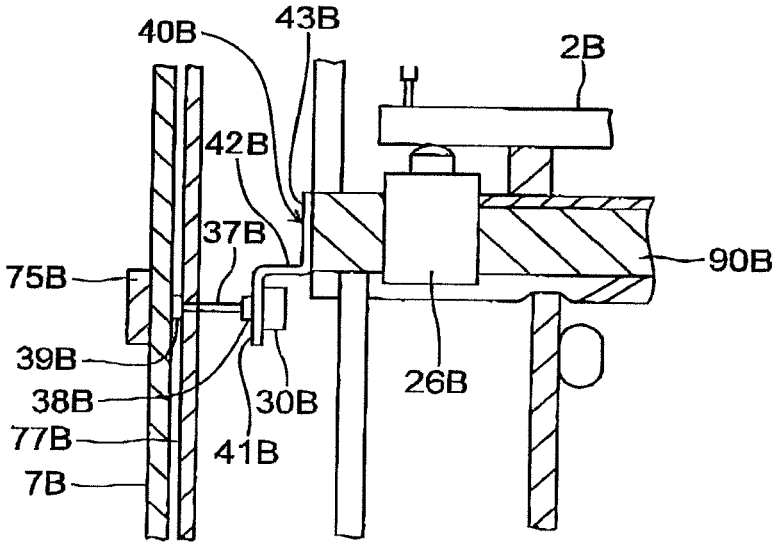
FIG. 17 is a view for explaining a position of the acoustic transducer according to an eighth modification of the embodiment.

There will be next explained the eighth modification in which the fixture 40B in the seventh modification is modified. As shown in FIG. 17, the fixture 40B in the eighth modification has a third flat plate portion 43B in addition to the first flat plate portion 41B and the second flat plate portion 42B. The third flat plate portion 43B is formed such that the third flat plate portion 43B extends from one end of the second flat plate portion 42B so as to be bent at the right angle and such that the third flat plate portion 43B integrally extends in parallel to the first flat plate portion 41B in a direction opposite to a direction in which the first flat plate portion 43B extends from the second flat plate portion 42B. In this instance, in place of the second flat plate portion 42B, the third flat plate portion 43B is fixed to the key bed 90B of the upright piano 1B by screwing or by using an adhesive, whereby the acoustic transducer 30B and the fixture 40B are fixedly installed on the key bed 90B. In the arrangement, in addition to the first flat plate portion 41B, the second flat plate portion 42B also vibrates with respect to the key bed 90B and the third flat plate portion 43B, so as to ensure advantages similar to those in the embodiment and the first through seventh modifications described above.

In the eighth modification, the first flat plate portion 41B and the third flat plate portion 43B are bent with respect to the second flat plate portion 42B at an angle of 90 degrees. The first flat plate portion 41B and the third flat plate portion 43B may be bent with respect to the second flat plate portion 42B at an angle of less than or larger than 90 degrees. For instance, the first flat plate portion 41B, the second flat plate portion 42B, and the third flat plate portion 43B may be formed so as to have a Z-shaped cross-sectional shape. It is noted that such modification of the fixture 40B is applicable to the embodiment and the first through seventh modifications described above.

<Other Modifications>

In the embodiment and the first through eighth modifications, the acoustic transducer 30, 30B is configured to vibrate the soundboard 7, 7B such that vibration of the bobbin 35 is transmitted to the soundboard 7, 7B via the drive rod 37. Instead, the bobbin 35 may be closely fixed directly to the soundboard 7, 7B, in other words, the bobbin cap 38 of the bobbin 35 may be closely fixed directly to the soundboard 7, 7B, whereby vibration of the bobbin 35 may be transmitted directly to the soundboard 7, 7B to cause the soundboard 7, 7B to be vibrated.

In the embodiment and the first through eighth modifications described above, the magnets 31, 33 and the yokes 32, 34 are constituted integrally so as to constitute the main body of the acoustic transducer 30, and the vibration characteristics of the main body of the acoustic transducer 30 are not taken into account. However, the vibration characteristics of the main body of the acoustic transducer 30 may be suitably set by interposing a buffer or damping member for damping vibration in a specific frequency range or a vibration intensifying member for emphasizing vibration in a specific frequency range, between interfaces of the magnets 31, 33 and the yokes 32, 34.

In the embodiment and the first through eighth modifications, there are explained: a case in which the musical instrument sound signal is generated from the sound source 151 in accordance with driving of the key 2, 2B based on the performance operation of the key 2, 2B and the pedal 3, 3B and the automatic performance data; and a case in which the musical, instrument sound signal is generated from the sound source 151 by introducing the automatic performance data directly to the sound source 151. Instead, the musical instrument sound signal may be generated from the sound source 151 in accordance with performance operation of performance operating elements other than the key 2, 2B and the pedal 3, 3B. Moreover, the musical instrument sound signal (audio signal) may be recorded in a recording medium such as a compact disk (CD) and a hard disk (HD), and sounds may be generated by reproducing the recorded musical instrument sound signal.

In the embodiment and the first through eighth modifications, the present invention is applied to the grand piano 1 or the upright piano 1B. The present invention is applicable to electronic musical instruments that usually do not have the soundboard, such that the soundboard configured to be vibrated by the musical instrument sound signal is newly provided and the newly provided soundboard is vibrated by the acoustic transducer. In this instance, the soundboard is fixed to a support member such as a sideboard or a frame of the electronic musical instruments. Moreover, the present invention is applicable to acoustic signal generating devices not in the form of musical instruments, configured to generate the musical instrument sound signal by vibrating the soundboard. In this instance as well, the main body of the acoustic transducer is fixed to the support member other than the soundboard.

What is claimed is:

1. A soundboard acoustic transducer, comprising:

a main body; and a vibrator configured to vibrate a soundboard in response to a sound signal input thereto, wherein the main body is supported by a member different from the soundboard, via a fixture formed by a metal plate, wherein the fixture is configured to vibrate in a perpendicular direction with respect to a plate surface thereof in a frequency range at least from 4 kHz to 15 kHz, wherein the fixture has a first plate portion fixed to the main body and a second flat plate portion fixed to the member, wherein the first flat plate portion has at least one extending portion that is supported by the first flat plate portion and that extends in a substantially perpendicular direction with respect to the first flat plate portion, and wherein each of the at least one extending portion is provided so as to be spaced apart from the second flat plate portion.

2. The soundboard acoustic transducer according to claim 1, wherein the fixture is constructed to have an L-shaped cross-sectional shape.

3. The soundboard acoustic transducer according to claim 2, wherein each of the at least one extending portion extends integrally from the first flat plate portion.

4. The soundboard acoustic transducer according to claim 2, wherein a protrusion having one of a circular cross-sectional shape and an oval cross-sectional shape is provided on the first flat plate portion.

5. The soundboard acoustic transducer according to claim 1, wherein the main body portion has a yoke and a magnet, and wherein the vibrator has a bobbin around which a coil is wound.

6. The soundboard acoustic transducer according to claim 1, wherein the second flat plate portion comprises a first end portion and a second end portion that is located at a position further from the soundboard than the first end portion, wherein the first flat plate portion extends from the first end portion of the second flat plate portion in a direction perpendicular to the second flat plate portion, wherein the first flat plate portion comprises a first surface and a second surface facing opposite each other, and wherein the vibrator is fixed on the first surface, which is located at a position further from the soundboard than the second surface, of the first flat plate portion.

7. The soundboard acoustic transducer according to claim 6, wherein the soundboard acoustic transducer is disposed below the soundboard, wherein the first end portion of the second flat plate portion is above the second end portion, and wherein the first surface of the first flat plate portion is below the second surface of the first flat plate portion.

* * * * *